United States Patent [19]

Vidusek et al.

[11] Patent Number: 5,065,945

[45] Date of Patent: Nov. 19, 1991

[54] MULTIPLE HEAD SPRAY NOZZLE ASSEMBLY WITH COMMON SUPPLY MANIFOLD

[75] Inventors: Daniel A. Vidusek, St. Charles; Justin D. White, Carol Stream, both of Ill.

[73] Assignee: Spraying Systems Co., Wheaton, Ill.

[21] Appl. No.: 503,810

[22] Filed: Apr. 3, 1990

[51] Int. Cl.[5] ..... B05B 1/14

[52] U.S. Cl. ..... 239/556; 239/568

[58] Field of Search ..... 239/553.3, 553.5, 556, 239/558-559, 566-568; 164/444, 348; 266/113, 259

[56] References Cited

FOREIGN PATENT DOCUMENTS 999898 11/1976 Canada ..... 239/556

*Primary Examiner*—Andres Kashnikow

*Assistant Examiner*—Lesley D. Morris

*Attorney, Agent, or Firm*—Leydig, Voit & Mayer

[57] ABSTRACT

An improved spray nozzle assembly particularly adapted for use in dispersing cooling fluids onto the opposed relatively narrow sides of a pair of slabs in a split or twin cast continuous steel casting system. The discharging spray nozzle assembly is fashioned with a nozzle body having a manifold which is common to a plurality of transversely mounted spray nozzle heads. Each spray nozzle head has a plurality of closely spaced, slit-like discharge openings that communicate with the manifold via a barrel-like mixing chamber and internal flow passages, Each of the discharge openings on each of said spray nozzle heads has a specifically configured shape to facilitate an even distribution of coolant throughout a substantially rectangular spray pattern.

19 Claims, 2 Drawing Sheets

MULTIPLE HEAD SPRAY NOZZLE ASSEMBLY WITH COMMON SUPPLY MANIFOLD

BACKGROUND OF THE INVENTION

The present invention relates generally to spray nozzles, and more specifically to an improved spray nozzle which imparts a generally rectangular shaped spray pattern and finds particular, but not exclusive, utility in apparatus for the continuous casting of steel slabs, ingots, billets, or the like. In such apparatus, the casting is conventionally formed in a vertically oriented mold and then withdrawn through a series of closely spaced guide and support rollers, where its direction is changed from vertical to horizontal. It is a common practice in continuous casting to spray coolants, such as water mist, onto the moving slab in order to cool and solidify the steel. In order to accomplish the cooling process efficiently, and without loss or degradation of product, the spray must be applied with relative uniformity and in sufficient amounts to effectuate the cooling. For this purpose, it is known to mount spray nozzles in adjacent relation to the major faces of the slab, so that cooling liquid can be directed and discharged in the desired spray pattern.

In lieu of casting one large slab, it is common to employ a casting system, referred to as a split cast or twin cast system, whereby flat slabs are simultaneously cast in closely-spaced substantially coplanar relation to each other. Because of the relatively close spacing between the usually narrow sides of the adjacent slabs, difficulties have arisen in providing an even distribution of coolant along the sides of the slabs. The present invention addresses these difficulties and provides a spray nozzle assembly that directs a discharge of cooling fluids against a rectangular side section of the moving steel slabs.

The following U.S. patents disclose various forms of coolant spraying systems used for cooling products formed in continuous casting apparatus: U.S. Pat. Nos. 4,256,168 to Hein et al.; 4,211,252 to Schrew et al.; 4,136,527 to Kading; 4,349,156 to Haruch et al.; and 4,591,099 to Emory et al.

SUMMARY OF THE INVENTION

One object of the invention is to provide a spray nozzle assembly of the character set forth above, which will produce a high degree of atomization of the liquid and a uniform distribution of liquid spray throughout a predetermined spray pattern.

It is a further object of the invention to provide a coolant spray nozzle assembly for continuous casting apparatus and the like which is adapted to effectively disperse cooling fluids onto the opposed relatively narrow sides of a pair of slabs in a split or twin cast continuous steel casting system.

Another object of the invention is to provide a unitary spray nozzle assembly, which is adapted to simultaneously disperse cooling fluids against the opposing sides of two adjacent cast steel slabs.

Still another object of the invention is to provide a spray nozzle assembly of the kind which has a common manifold with a plurality of transversely directed spray nozzle heads, each of which is adapted for dispersing a substantially rectangular spray discharge pattern.

The foregoing is accomplished by the use of an air-hydraulic upper unit serving as a preliminary coolant atomizing source; a relatively long tubular barrel into which the preliminary atomizing source discharges at high velocity, thus giving the atomized coolant large momentum; and a combined mixing and discharging spray nozzle assembly fixed to and communicating with the long tubular barrel. The discharging spray assembly is fashioned with a nozzle body having a manifold which is common to a plurality of transversely mounted spray nozzle heads. Each spray nozzle head has a plurality of axially spaced, slit-like discharge openings that communicate with the manifold via a barrel-like mixing chamber. In accordance with the present invention, each of the discharge openings in each of the spray nozzle heads has a specifically configured shape to facilitate an even distribution of coolant throughout a substantially rectangular spray pattern.

DETAILED DESCRIPTION OF THE INVENTION

Figure 7:
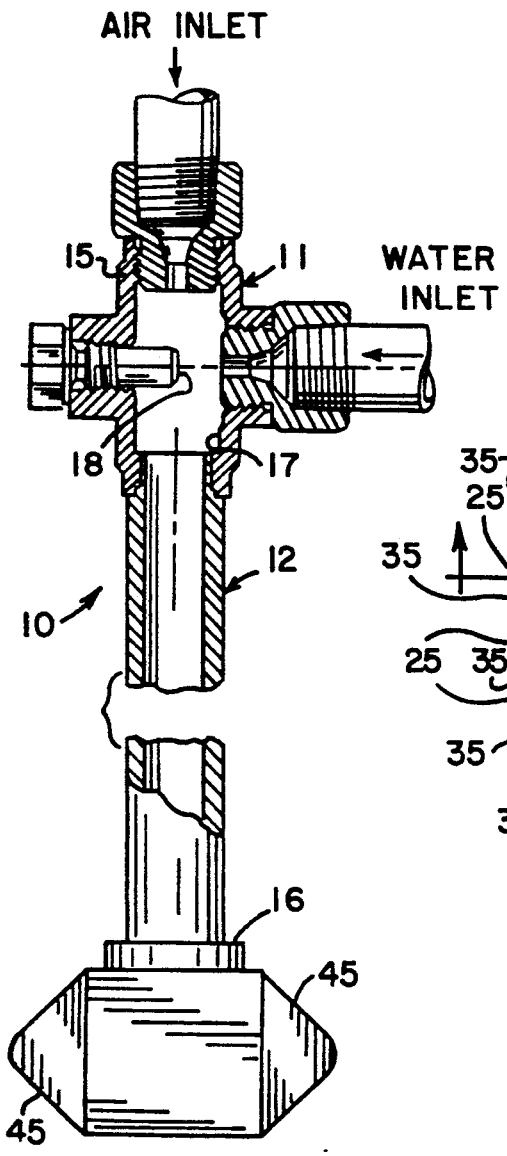
FIG. 7 is a section of the nozzle assembly and preatomizing head coupled thereto.

As noted earlier, the spray nozzle of the present invention finds particular utility in apparatus for the continuous twin or split casting of steel slabs, ingots, billets and the like. The arrangement of the nozzle assembly 10 in relation to the steel slabs or billets is shown generally in FIGS. 1 and 2. For providing a preatomized liquid to the nozzle assembly 10, the nozzle assembly 10 in this instance includes an atomizing unit 11 upstream thereof. The atomizing unit 11 may be of a type such as shown in U.S. Pat. No. 4,591,099, assigned to the same assignee as the present application. The atomizing unit 11, as shown in FIG. 7, comprises a hollow body 15 having an expansion chamber 17, which in turn is coupled to an elongated tubular barrel 12. The coolant, such as cooling water and air, are introduced under pressure into the expansion chamber. An impingement surface 18 is located within the expansion chamber 17, against which the liquid impinges and a pressurized air stream is directed across the impingement surface 18 to further break up and atomize the liquid. A high velocity stream of air and atomized fluid droplets result and are directed from the expansion chamber 17 through the elongated barrel 12, and is injected into the nozzle assembly 10, where it is subjected to increased turbulence and further mixing. The stream is then discharged at high velocity from the nozzle assembly 10 as a fine, uniform mist in a predetermined, generally rectangular shaped spray pattern, and is adapted to be directed against the rectangular sides of the moving slabs.

Figure 1:
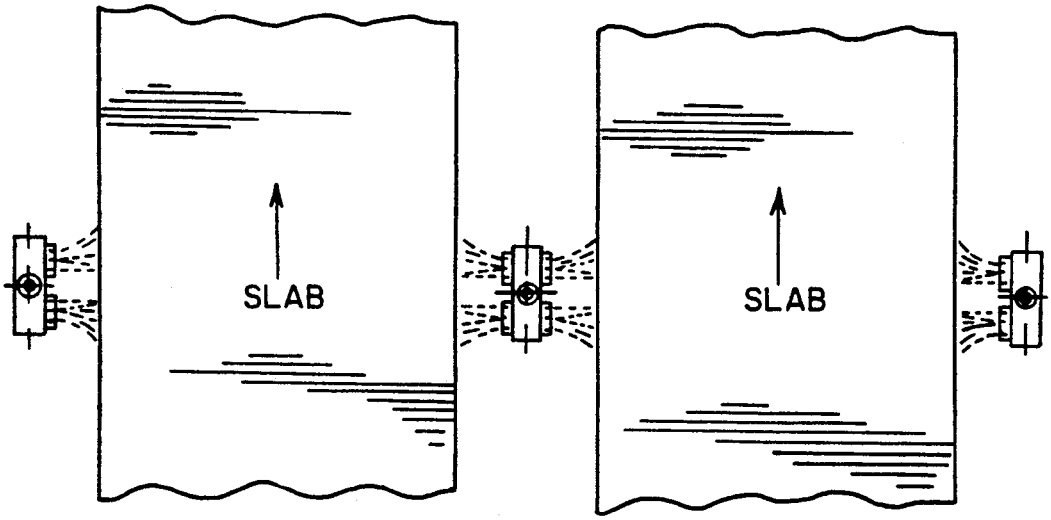
FIG. 1 is an illustration of a split or twin cast continuous steel casting system showing two cast steel slabs in closely spaced coplanar relation, and illustrating the arrangement of the spray nozzles in relation to the sides of the steel slabs.
Figure 2:
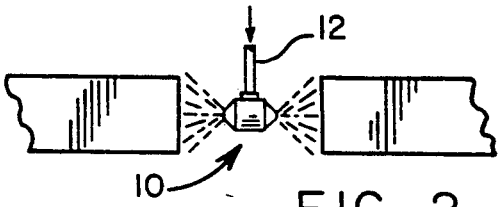
FIG. 2 is a side elevational view of the center spray nozzle shown FIG. 1.

As illustrated in FIGS. 1 and 2, a spray nozzle assembly 10 is inserted in the space between adjacent slabs The spray from the nozzle heads of this assembly 10 discharges from opposite sides of the assembly against the relatively narrow opposing sides of both slabs. Also as shown in FIG. 1, and described hereinafter, the nozzle assembly can be modified to discharge from only one side so as to direct spray against the outer or exposed side of the slabs. The nozzle assembly shown in FIGS. 1 and 2 may be supported in any suitable manner, and the support means may include provision for adjusting their positions and appropriate piping for supplying the necessary pressurized air and water to enable them to direct a uniform spray against the sides of the steel slabs. This is accomplished by the interaction of the structural features of the nozzle assembly as described below.

Figure 3:
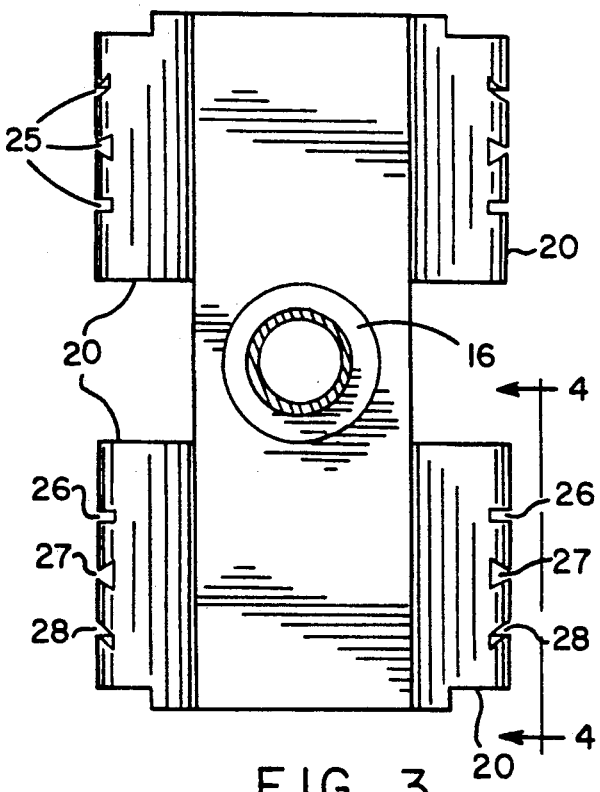
FIG. 3 is an enlarged, plan view of the center spray nozzle assembly shown in FIG. 1.
Figure 4:
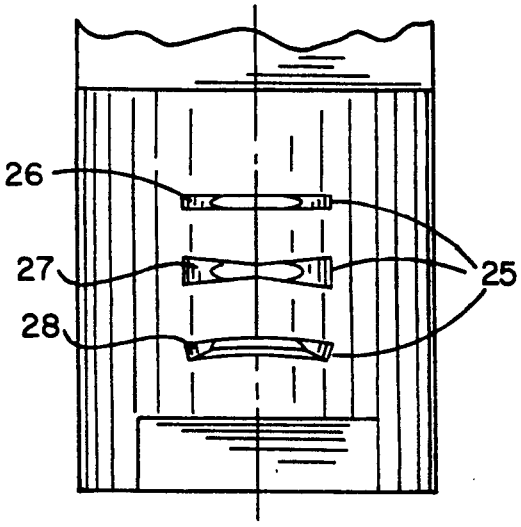
FIG. 4 is an enlarged side view of a spray nozzle head taken in the plane of line 4—4.

The shape of the spray pattern and the distribution of atomized coolant droplets within that pattern are determined by the mixing and discharge nozzle assembly 10. As shown in more detail in FIGS. 3 and 4, the assembly comprises a body 15 having a central internally threaded hub 16, which receives the external threaded end of the elongated barrel 12. As shown in FIG. 3, four spray nozzle heads 20 are associated with the body 15. The heads 20 are preferably arranged in opposing pairs, so that the cooling spray can be discharged from opposite sides of the spray nozzle assembly. As shown in more detail in FIG. 4, each spray nozzle head has a plurality of discharge openings 25, with each opening having a specifically configured shape. The top discharge opening 26 shown in FIG. 4, or in other words, the discharge opening closest to the hub 16 of the assembly, is adapted to direct a substantially straight, relatively narrow liquid discharge. The center opening 27 of each nozzle has a bow tie shape and thus directs a relatively narrow fan-shaped discharge; while the bottom opening 28, or in other words, the outermost opening on the assembly, has an outwardly and downwardly curved shape resulting in a somewhat arcuate shaped discharge directed to the outer edges of the assembly. Because of the negative pressures developed between the discharging sprays, the lower, arcuate shaped spray pattern is drawn somewhat into closer arrangement with the spray discharging from the center opening, resulting in a substantially rectangular spray discharge pattern.

Figure 5:
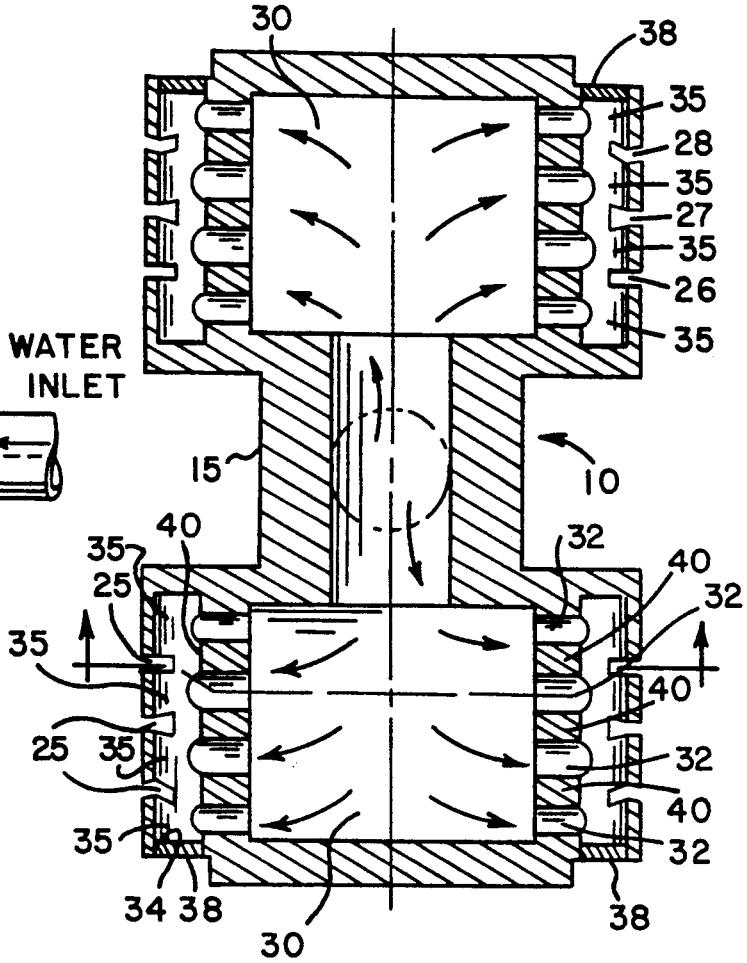
FIG. 5 is an enlarged longitudinal sectional view taken through the center of the spray nozzle assembly shown in FIG. 3.
Figure 6:
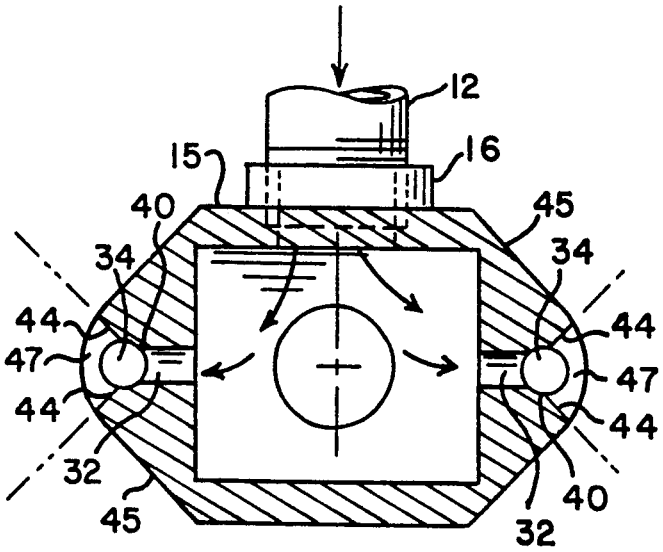
FIG. 6 is a transverse sectional view taken in the plane of line 6—6.

Referring more specifically to FIGS. 5 and 6, it will be noted that the body 15 includes a manifold 30 that is common to the transversely mounted spray nozzle heads 20, and which communicates, via a plurality of internal flow passages 32 and a barrel like mixing chamber 34, with the slit-like discharge openings 25 associated with each spray nozzle head. As shown in FIG. 5, the internal flow passages 32 are laterally offset from the discharge openings 25 for directing the cooling liquid against internal wall portions 35 of the barrel-like mixing chamber 34. The wall portions 35 are adjacent to the slit-like discharge openings 25, and the arrangement of the internal flow passages 32 and the wall portions 35 results in a more uniform liquid flow through the plurality of discharge openings 25.

As shown in more detail in FIG. 6, the mixing chamber 34, which is disposed in parallel relation to the face of the spray nozzle head 20, is cylindrical in shape. For convenience in manufacture, the chamber 34 may be formed by drilling or otherwise forming a hole in the spray nozzle assembly and then sealing the opening in the side wall by means of a fixed plug 38.

In order to enhance the mixing of the atomized droplets and air entering the mixing chamber 34, the internal flow passages 32 extend transversely to the longitudinal axis of the cylindrical mixing chamber and intersect the wall of mixing chamber 34 opposite the discharge openings 25. The intersecting planes may penetrate the cylindrical chamber 34 in spaced radial relation to its longitudinal axis, and in this case may be situated inside the chamber a distance of approximately $\frac{1}{3}$ to $\frac{1}{2}$ the radius of the latter. This relationship between the cylindrical wall of the mixing chamber and each of the internal flow passages defines a pair of diametrically opposed land segments 40 which straddle the mixing chamber.

The slit-like discharge openings 25 communicate between the mixing chamber 34 and the exterior of the nozzle assembly 10. As shown in FIGS. 3–6, the openings extend circumferentially across the outer surface of the spray nozzle head 20. The top discharge opening 26 is a substantially straight, relatively narrow cut in the face of the nozzle head 20. The center opening is of a bow tie configuration, and is narrowest along the center line of the spray nozzle, and widest at the outer periphery thereof. The sides of the center opening are undercut so that it has a slight taper narrowing down as the outer peripheral surface of the head is approached. The third and outermost discharge opening 28 is curved outwardly, and when cut is rotated through a small angle, such as 5°. The outer end portions of the lands 40 have chamfered surfaces 44 which define the throat of each of the discharge openings. These surfaces 44 subtend an angle, which in the illustrated embodiment as shown in FIG. 6, is approximately 120°. The outer surface 45 of each spray nozzle head 20 preferably has an outwardly bowed, arcuate shape when viewed in a plane transverse to the longitudinal axis of the body 15, such that surfaces 47 of the spray nozzle, which define the openings, tend to enhance the uniformity of discharge from the nozzle.

In the operation of the nozzle assembly, the atomizing unit generates a high velocity stream of air and atomized fluid droplets which is directed through the elongate tubular barrel 12 to the nozzle assembly 10. The stream proceeds into the manifold 30, through the internal flow passages 32, and into the barrel-like mixing chamber 34. The internal flow passages direct the cooling fluid against internal wall portions 35 on the interior surface of the mixing chamber, adjacent the respective discharge openings 25, which produces a more uniform liquid flow through the plurality of discharge openings. The mixing chamber 34 facilitates further mixing of the atomized droplets and the moving air stream. The mixture of finely atomized fluid and air is then discharged from the nozzle assembly through the discharge openings 25 in a predetermined spray pattern of generally rectangular shape, with the fluid distributed uniformly as a fine mist throughout the pattern.

While this invention has been disclosed primarily in terms of specific embodiments thereof, it is not intended to be limited thereto. Other modifications and embodiments will be apparent to those skilled in this art. For example, one skilled in the art will appreciate that additional discharge openings may be arranged in the spray nozzle, so long as the spray pattern remains substantially rectangular in shape. Those skilled in the art will also appreciate that the nozzle assembly 10 shown in FIG. 5 can be modified, so that coolant is discharged from only one side of the assembly, by inserting a plug in the body 15 in lieu of a spray nozzle head.

We claim as our invention:

1. A spray nozzle assembly for directing fluid in a substantially rectangular spray pattern comprising, in combination:

(a) a body portion having a manifold and at least one spray nozzle head;

(b) said body portion having means for permitting the coupling thereof to a fluid supply line;

(c) each of said nozzle heads having means defining a mixing chamber and means defining an internal flow passage for directing fluid from said manifold to the mixing chamber of each nozzle head; and (d) means defining a plurality of elongated parallel discharge openings in each of said nozzle heads communicating with said mixing chamber, said discharge openings being arranged in closely spaced relation for discharging a spray pattern of generally rectangular shape with the fluid distribution substantially uniform throughout the pattern.

2. The spray nozzle assembly of claim 1 wherein said internal flow passage intersect said mixing chamber and direct fluid against internal wall portions of said mixing chamber adjacent said discharge.

3. A spray nozzle assembly adapted to dispersed cooling fluids onto the opposed relatively narrow sides of a pair of slabs in a split or twin cast continuous steel casting system comprising, in combination:

(a) a body portion having a manifold which is common to a plurality of transversely mounted spray nozzle heads;

(b) said body portion having means for permitting the coupling thereof to a fluid supply line;

(c) each of said nozzle heads having means defining mixing chamber and means defining an internal flow passage for directing fluid from said manifold into the mixing chamber of each nozzle head;

(d) means defining a plurality of elongated parallel discharge openings in each of said nozzle heads communicating between the mixing chamber and the exterior of the nozzle assembly, said discharge openings being arranged in closely spaced relation for discharging a spray pattern of generally rectangular shape with the fluid distribution substantially uniform throughout the pattern.

4. A spray nozzle assembly for directing fluid in a substantially rectangular spray pattern comprising, in combination:

(a) a body portion having a manifold and at least one spray nozzle head;

(b) said body portion having means for permitting the coupling thereof to a fluid supply line;

(c) each of said nozzle heads having means defining a generally cylindrically shaped mixing chamber and means defining an internal flow passage for directing fluid from said manifold to the mixing chamber of each said head; and (d) means defining a plurality of discharge openings in each of said nozzle heads communicating with said mixing chamber, said discharge openings arranged in closely spaced relation and configured to discharge a substantially rectangular spray pattern.

5. A spray nozzle assembly for directing fluid in a substantially rectangular spray pattern comprising, in combination:

(a) a body portion having a manifold and at least one spray nozzle head;

(b) said body portion having means for permitting the coupling thereof to a fluid supply line;

(c) each of said nozzle heads having means defining a mixing chamber and means defining internal flow passage for directing fluid from said manifold to the mixing chamber of each said nozzle head;

(d) means defining a plurality of discharge openings in each of said nozzle heads communicating with said mixing chamber, said discharge openings arranged in closely spaced relation and configured to discharge a substantially rectangular spray pattern, (e) said internal flow passages intersecting said mixing chamber for defining lands that straddle said mixing chamber, said lands being formed with an outwardly chamfered face which defines a throat of said discharge openings, and (f) said internal flow passages being located for directing fluid against internal wall portions of said mixing chamber adjacent said discharge openings.

6. The spray nozzle assembly of claim 5 wherein said chamfered faces subtend an angle of approximately 120°.

7. The spray nozzle assembly of claim 5 including an atomizing unit adapted for receiving separate streams of liquid and air and for delivering a high velocity stream of atomized droplets of fluid mixed with air, and means coupling said atomizing unit to said body portion of said nozzle assembly.

8. The spray nozzle assembly of claim 4 wherein said discharge means comprise a plurality of slit-like discharge openings arranged transversely to the longitudinal axis of said generally cylindrical mixing chamber, one of said discharge openings being adapted to direct a substantially straight, relatively narrow fluid discharge, another discharge opening being narrowest at its center and tapering to maximum width at its outer ends and adapted to direct a relatively narrow fan-shaped discharge, and another discharge opening having an outwardly and downwardly curved shape adapted to direct a somewhat arcuate shaped discharge.

9. The spray nozzle assembly of claim 8 wherein said spray nozzle head has an outwardly bowed, arcuate shape and said slit-like discharge openings extend circumferentially across the arcuate surface of said spray nozzle head.

10. A spray nozzle assembly adapted to dispersed cooling fluids onto the opposed relatively narrow sides of a pair of slabs in a split or twin cast continuous steel casting system comprising, in combination:

(a) a body portion having a manifold which is common to a plurality of transverse mounted spray nozzle heads;

(b) said body portion having means for permitting the coupling thereof to a fluid supply line;

(c) each of said nozzle heads having means defining a mixing chamber and means defining an internal flow passage for directing fluid from said manifold to the mixing chamber of each said head; and (d) means defining a plurality of slit-like closely spaced discharge openings in each of said nozzle heads communicating between the mixing chamber and the exterior of the nozzle assembly for discharging a substantially rectangular spray pattern, one of said discharge openings being adapted to direct a substantially straight, relatively narrow fluid discharge, another of said discharge openings being narrowest at its center and tapering to maximum width at its outer ends and adapted to direct a relatively narrow fan-shaped discharge, and another of said discharge openings having an outwardly and downwardly curved shape adapted to direct a somewhat arcuate shaped discharge.

11. The spray nozzle assembly of claim 10 in which each said spray nozzle head has an outwardly bowed, arcuate shape.

12. The spray nozzle assembly of claim 1 in which said body portion has a head on opposite sides thereof.

13. The spray nozzle assembly of claim 12 in which said body portion has a plurality of heads on opposite sides thereof.

14. The spray nozzle assembly of claim 3 in which said body portion has a head on opposite sides thereof.

15. The spray nozzle assembly of claim 14 in which said body portion has a plurality of heads on opposite sides thereof.

16. The spray nozzle assembly of claim 1 including means defining a plurality of internal flow passages from said manifold to the mixing chamber of each said nozzle head.

17. The spray nozzle assembly of claim 16 in which the internal flow passages of each nozzle head are located in longitudinally offset relation to the discharge openings in the respective nozzle head.

18. The spray nozzle assembly of claim 3 including means defining a plurality of internal flow passages from said manifold tot he mixing chamber of each said nozzle head.

19. The spray nozzle assembly of claim 18 in which the internal flow passages of each nozzle head are located in longitudinally offset relation to the discharge openings in the respective nozzle head.

* * * * *